United States Patent [19]

Reynolds

[11] 4,455,217

[45] Jun. 19, 1984

[54] RETORTING PROCESS

[75] Inventor: Bruce A. Reynolds, San Rafael, Calif.

[73] Assignee: Chevron Research Company, San Francisco, Calif.

[21] Appl. No.: 324,793

[22] Filed: Nov. 25, 1981

[51] Int. Cl.[3] ..... C10G 1/00

[52] U.S. Cl. ..... 208/11 R; 208/8 R

[58] Field of Search ..... 208/11 R, 8 R

[56] References Cited

U.S. PATENT DOCUMENTS

| | | | |
|---|---|---|---|
| 3,839,186 | 10/1974 | Berger | 208/8 R |
| 4,069,133 | 1/1978 | Unverferth | 208/11 R |
| 4,105,502 | 8/1978 | Choi | 208/11 R |
| 4,183,800 | 1/1980 | Mitchell et al. | 208/11 R X |
| 4,246,093 | 1/1981 | Wolcott, Jr. | 208/11 R X |
| 4,263,124 | 4/1981 | Wickstrom et al. | 208/11 R X |
| 4,266,699 | 10/1980 | Nutter | 208/11 R |

*Primary Examiner*—W. J. Shine
*Assistant Examiner*—Glenn A. Caldarola
*Attorney, Agent, or Firm*—Burns, Doane, Swecker & Mathis

[57] ABSTRACT

Fines in the overhead vapors from an oil shale retort process in which fresh shale together with hot recycle combusted shale from a combustor are fed to a retort and at least partly fluidized by a countercurrent stripping gas stream are handled by (a) removing a portion of the fines in a vapor-solid separation (b) optionally subjecting the portion of fines to additional retorting in a fines retort (c) condensing the partially dedusted gas (d) separating the condensate into a substantially fines-free liquid oil and a wet solids and (e) recycling at least a portion of the wet solids to the retort, fines retort, and/or combustor whereby the liquid on the wet solids is recovered and/or burned and the wet solids are dried.

9 Claims, 1 Drawing Figure

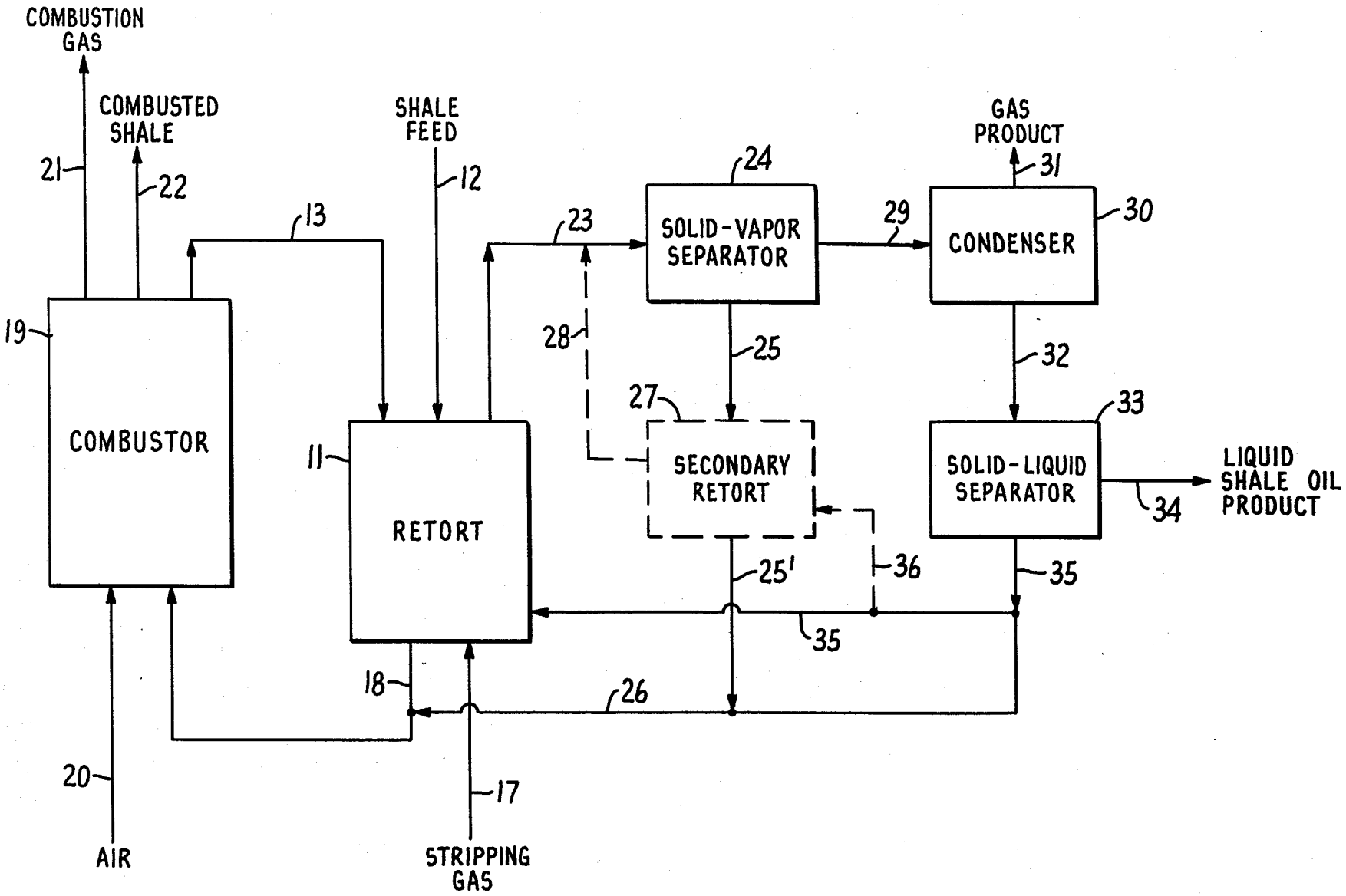
GAS PRODUCT
31
30
CONDENSER
32
33
SOLID-LIQUID SEPARATOR
35
LIQUID SHALE OIL PRODUCT
34
29
24
SOLID-VAPOR SEPARATOR
25
SECONDARY RETORT
25'
36
35
27
28
23
26
SHALE FEED
12
RETORT
11
17
STRIPPING GAS
18
13
COMBUSTOR
19
COMBUSTED SHALE
22
COMBUSTION GAS
21
20
AIR

RETORTING PROCESS

BACKGROUND OF THE INVENTION

1. Field of the Invention

The invention relates generally to a retorting process for obtaining oil from hydrocarbon-containing solids, such as oil shale. The invention relates specifically to that part of a retorting process in which fines are removed from the liquid oil produced in the process.

2. Description of the Prior Art

Oil shale is a fine-grained sedimentary rock that contains an organic material called kerogen. Upon strong heating of the raw shale, the kerogen will decompose or pyrolyze to yield liquid oil, gases, and residual carbon that remains on the shale. The process of pyrolyzing the kerogen in the raw shale is known as "retorting."

Retorting of raw oil shale is basically a simple operation which involves heating the raw oil shale to an appropriate temperature and removing the vapors evolved from the kerogen pyrolysis. The overhead vapors typically contain varying amounts of entrained particles (commonly called fines or dust) depending upon the particulate nature of the shale feed and the kind of retorting process involved. It is usually necessary to remove the fines from the overhead vapors to avoid contaminating the liquid oil product and rendering it unsuitable as a feed to conventional refining operations. In many retort processes the fines in the overhead vapors are of such size and concentration that they may be removed effectively in one or more solid-vapor separation steps. Devices such as hot cyclone separators and electrostatic precipitators have been used or suggested for this purpose.

U.S. Pat. No. 4,133,739 exemplifies a fluidized bed retorting process in which fines are separated from the overhead vapors and are recycled to the retort vessel. Retorting occurs in an upper portion of the retort vessel and combustion of the char on the retorted shale to provide the heat of retorting occurs in the lower portion of the retort vessel. The fines entrained in the overhead stream are separated and returned to the combustion portion of the vessel where the char thereon is burned to supply a portion of the heat for retorting. The patent teaches a condensation step that follows the solid-vapor separation to recover the liquid oil from the dedusted gas vapor phase. There is no mention of further treatment of the condensate to remove any solids that might be present therein.

U.S. Pat. No. 4,199,432 describes a staged turbulent bed retort process that may produce substantial concentrations of fines in the retort vapors depending upon the particular feed and operating conditions used. Raw hydrocarbon-containing solids are fed together with a hot heat transfer material that supplies the heat for retorting down through a retort vessel while a nonoxidizing stripping/fluidizing gas is passed countercurrently and upwardly through the vessel. The retorted solids and heat transfer material are taken from the bottom of the vessel and passed to a combustor where the char on the retorted solids is combusted to heat the heat transfer material. The retort vapors together with the stripping gas are taken overhead from the retort vessel and subjected to a conventional solid-vapor separation to remove entrained fines. The fines are returned to the bottom of the combustor. The dedusted vapor stream is then condensed and the condensate is distilled into product.

The "Lurgi-Ruhrgas" retort process involves a feed (particle size usually below one cm nominal diameter) and retorting procedures that give rise to substantial amounts of fines in the overhead vapors. The Lurgi-Ruhrgas process is similar to the process of U.S. Pat. No. 4,199,432 described above in that retorted solids are passed to a combustor where the char is combusted to generate heat and raise the temperature of a heat transfer material. The vapor product from the retort is subjected to a solids separation and then to a multi-stage condensation. Literature relating to this process suggests either recycling the heavy oil from the first condensation stage to the retort to dedust and crack it, recycling the heavy oil to the combustion zone as a combustion fuel, or centrifuging the heavy oil after treatment with a solvent, drying the centrifuge residue with steam, and disposing of the dried sediment.

U.S. Pat. No. 4,226,699 describes an oil shale retorting process in which a sludge recovered from the retort vapors is combusted to heat flue gases that are used to preheat the raw oil shale. More specifically, this process involves preheating the oil shale in a series of lift pipes by contact with hot flue gases. The preheated shale is retorted and the retort vapors are taken overhead and condensed. The condensate is subjected to a liquid-solids separation to form the combustable sludge. This sludge is pumped to a combustor positioned between the last and penultimate lift pipes where it is mixed with flue gases from the last lift pipe and combusted to heat those gases.

SUMMARY OF THE INVENTION

The invention is an improvement in a retorting process that employs a finely crushed hydrocarbon-containing solids feed and employs a heat transfer material that is heated by combusting retorted solids to heat the hydrocarbon-containing solids feed to temperatures at which retorting occurs. For instance, this improvement may be used in the processes of U.S. Pat. Nos. 4,133,739 and 4,199,432 and the Lurgi-Ruhrgas process described above. Specifically, the retort process to which the invention is directed involves the following steps:

(a) introducing fresh hydrocarbon-containing solids having a maximum particle size less than about one cm into the upper portion of a retorting zone;

(b) introducing a particulate heat transfer material at an elevated temperature into the upper portion of the retorting zone;

(c) introducing a nonoxidizing stripping gas into the lower portion of the retorting zone at a linear velocity that fluidizes a portion of the fresh hydrocarbon-containing solids and heat transfer material dropping through the retorting zone and causes mixing therebetween whereby sufficient heat is transferred from the heat transfer material to the fresh hydrocarbon-containing solids to heat the hydrocarbon-containing solids to a temperature at which retorting occurs;

(d) withdrawing a mixture of retorted solids and heat transfer material from the retort zone and introducing it into a combustion zone wherein the char on the retorted solids is combusted to heat the heat transfer material to said elevated temperature;

(e) withdrawing an overhead stream from the upper portion of the retorting zone that comprises stripping gas, the vapors of retorting, and entrained fines having a maximum particle size less than about 250 microns;

(f) removing a portion of said fines from the overhead stream, said portion being comprised predominantly of particles having a particle size greater than about five microns;

(g) optionally subjecting the portion of the fines removed from the overhead to additional retorting in a second retorting zone and combining the vapors from the second retorting zone with said overhead stream;

(h) thereafter condensing the overhead stream to produce a liquid condensate containing substantially all of the entrained fines remaining in the stream after step (f); and (i) removing at least a substantial portion of the fines from the condensate to produce a liquid oil product and a wet solids comprising the removed fines and up to about 40% by weight of the condensate.

The improvement comprises either:

(1) recycling at least a portion of the wet solids into the lower portion of the retort zone where the portion of the wet solids is contacted by the stripping gas thereby causing the liquid component of the wet solids to be vaporized and removed and the solids component of the wet solids to be dried, (2) recycling at least a portion of the wet solids into the combustion zone whereby the liquid component of the wet solids is combusted and the solid component of the wet solids is dried, or (3) recycling at least a portion of the wet solids into the second retorting zone whereby the liquid component of the wet solids is vaporized and removed and the solid component of the wet solids is dried.

BRIEF DESCRIPTION OF THE DRAWING

The drawing is a flow diagram illustrating a shale retorting process carried out according to the invention.

DETAILED DESCRIPTION OF THE INVENTION

The following detailed description is directed to the use of the invention to retort oil shale. It should be understood, however, that the invention may also be used in retorting other hydrocarbon-containing solids such as gilsonite, peat, and coal, mixtures of two or more hydrocarbon-containing solids, or mixtures of one or more hydrocarbon-containing solids and inert materials.

The term "retorted shale" is used herein to mean shale from which substantially all of the kerogen has been pyrolyzed but which still contains residual carbon or "char" left from the pyrolysis reaction.

The term "combusted shale" is used herein to mean retorted shale from which a substantial portion, preferably essentially all, of the combustible residual carbon has been burned.

The shale retorting process depicted in the drawing is one that uses recycled combusted shale as a medium for heating fresh shale feed to temperatures at which the kerogen in the feed is pyrolyzed. The shale feed is normally crushed into small particles before it is fed to the retort to reduce the retorting time and/or the size of the retort. The shale feed that is used in the invention process has a maximum particle size of less than about one cm, preferably less than about 0.4 cm. The particle size distribution of the feed is not critical and it will typically be fairly widespread. It will normally contain at least about 10% by weight particles of particle size below about 250 microns.

The shale is fed to a retort zone 11 via line 12 along with hot recycle combusted shale via line 13. Although the drawing shows these lines entering the top of the zone separately, it may be desirable to charge the combusted shale and feed at intermediate locations in the retort zone to avoid contaminating the vapors generated during retorting and reduce the likelihood of heating such vapors to temperatures that cause extensive cracking of the hydrocarbon components thereof. Downpipes or other means (not shown) may be used to transfer the incoming feed/combusted shale through the upper portion of the retort zone where the stripping gas and vapors of retorting collect and deentrainment of solids therefrom occurs.

The weight ratio of recycled combusted shale to feed will depend primarily on the temperatures of the combusted shale and fresh shale feed, the heat transfer efficiency between the combusted shale and the feed, and the desired retorting temperature (i.e., the temperature of the combusted shale-feed mix). The temperature of the combusted shale will usually be in the range of about 450° C. to about 750° C., more usually about 600° C. to about 750° C. The weight ratio of recycled combusted shale to shale feed will usually be in the range of about 1.5:1 to about 8:1, more usually about 2:1 to about 3:1. At these recycle ratios the hot combusted shale will rapidly heat the shale feed to retort temperatures in the range of about 475° C. to 525° C. At such temperatures the kerogen in the shale feed particles is pyrolyzed into vapors and char.

Efficient mixing of the recycled combusted shale and shale feed in the retort zone is achieved by maintaining at least a portion of the solids in a fluidized state by introducing a stripping gas into the bottom of the retort zone via conduit 17 and by including internal devices such as perforated trays, grids, or baffles within the zone that promote plug, staged flow of the solids down through the zone and reduce backmixing and slugging. Conditions and apparatus for achieving plug flow are described in U.S. Pat. No. 4,199,432 at cols. 6 and 7, which disclosure is incorporated herein by reference. Usually the flow rate of gas will be reduced in the upper portion of the retort zone to facilitate deentrainment of fines from the vapors being swept overhead. The linear velocity of the gas through the bed will usually be in the range of about 0.2 to 1 m/sec, more usually about 0.5 to 1 m/sec. The linear velocity is preferably reduced by a factor of two to three after the gas leaves the bed. The gas is preferably substantially free of oxygen or other gases that would promote oxidation reactions within the retort vessel. It will typically be steam, recycle product gas ($H_2$, CO, $CO_2$, and $C_1$–$C_4$ hydrocarbons), or mixtures thereof. As the gas passes up through the retort vessel its volume and composition change due to pick up of the vapor products of retorting.

The solids (except for those entrained in the overhead) exit the retort zone through line 18. These solids are comprised of retorted shale and combusted shale recycle. They are carried via line 18 into a combustion zone 19 where they are mixed with incoming air from conduit 20 and the char on the retorted shale is burned. The combustion of the char raises the temperature of the solids in the combustion zone from about 450° C. to about 600° C. to 750° C. The portion of the combusted shale not recycled to the retort zone is withdrawn from the combustion zone via line 22. The heat value of that portion may be recovered by conventional heat exchange techniques. For instance, it may be used to heat the stripping gas.

The vapor products of retorting together with the stripping gas and entrained solids leave the top of the retort zone through conduit 23. The entrained solids will usually have particle sizes below about 250 microns and will be about 0.5 to 5 times the weight of the vapor products in the overhead. The overhead stream is carried by line 23 into a solid-vapor separation zone 24 where a portion of the entrained solids is removed from the vapor phase. The separation zone will typically include one or more cyclone separators and/or filters. Preferably fines down to about five microns particle size are removed in the zone with a result that the vapors leaving the zone typically contain less than about 15% by weight, usually 5% to 10% by weight entrained fines. The heating value of the char contained on the fines removed in the zone is recovered by recycling the removed fines to the combustion zone via lines 25, 26, and 18. An optional process for treating the fines separated in zone 24 to simply combusting them is depicted in dashed lines in the drawing. This option is used in the event the fines carried overhead from the retort have not been retorted completely. It involves subjecting the separated fines to a secondary retorting in a fines retorting zone 27 where any kerogen remaining on the fines is pyrolized. Vapors from the secondary retorting are taken from the zone by line 28 and combined with the overhead stream from the retort zone. The retorted fines are carried by lines 25, 26, and 18 to the combustion zone.

The partially dedusted vapor phase leaves the solid vapor separation zone through line 29 and is carried thereby to a condensation zone 30. In the condensation zone the vapor phase is condensed into a gas product that comprises $H_2$, CO, $CO_2$, and $C_1$–$C_4$ hydrocarbons and a liquid product comprising hydrocarbons containing five or more carbon atoms and substantially all of the ultrafines contained in the vapor phase entering the condensation zone. The gas product is withdrawn from the zone via line 31 and as indicated above, may be used as stripping gas. The liquid condensate exits the zone by line 32 and passes to a solid-liquid separation zone 33.

The condensate is separated in zone 33 into a liquid shale oil product and a wet solids product. The permissible solids content of the liquid product from zone 33 will depend upon the particular downstream refining processes to which the shale oil product is subjected. Most downstream refining processes will require that the liquid product contain less than about 10% by weight solids, and more typically less than about one % weight solids. Preferably the liquid product contains less than 500 ppm solids. Correspondingly, the wet solids will usually contain less than about 40% by weight liquid, preferably less than 10% by weight liquid. Such separation may be achieved with available separation equipment such as centrifuges, filters, or combinations thereof. When using centrifuges and filters, it is desirable to cut the viscosity of the condensate with a light oil or other compatible solvent that can be readily removed from the centrate or filtrate and reused. As shown in the drawing, the liquid shale oil product (filtrate or centrate) is removed from the solid-liquid separation zone via line 34 and conducted thereby to further processing (not shown). The wet solids is removed from zone 33 by line 35.

According to the invention process the liquid remaining on the wet solids product from the liquid-solid separation may be either recovered by recycling the wet solids to either the bottom of the main retort zone via line 35 or the second retort zone via lines 35 and 36 or the heating value of the liquid hydrocarbons contained in the wet solids may be recovered by recycling the wet solids to the combustion zone via lines 26, 18. Depending upon the particular construction of the main retort zone, there may be more than one stripping gas inlet to that zone. The wet solids are introduced into the zone at a location that insures contact with all or a portion of the incoming stripping gas and will typically be located above one or more of the stripping gas inlet sites. It is also within this invention to split the wet solids into portions and recycle respective portions to any combination of the main retort zone, the fines retort zone, and the combustion zone. The wet solids will usually not be pasty and will have flow characteristics that permit them to be conveyed by conventional particulate solids conveying means such as augers, conveyor belts or pumps. Liquid hydrocarbons present in the wet solids recycled to the retort zone will be immediately vaporized from the solids by the hot fluidizing gas and carried thereby up through and out of the retorting zone. A substantial portion of the resulting dried solids will be carried by the downflowing retorted shale and combusted shale mix out of the retorting zone to the combustion zone. The dried solids will be removed from the combustion zone via line 22 or be entrained in the combustion gas flowing to downstream separators (not shown). Any entrained solids may be removed from the combustion gas effluent by conventional separator means such as precipitators or scrubbers (not shown). In contrast, liquid hydrocarbons present in the wet solids recycled to the combustion zone will be burned therein as a supplemental fuel. The dried solids remaining after the liquid has burned will either be removed by line 22 or entrained in the combustion gas and eliminated therefrom as described above.

Accordingly, any of the above described modes of handling the wet solids from the solid-liquid separation causes the liquid component of the wet solids to be recovered or used and the solids to be dried. This improves the yield and/or efficiency of the process and solves the problem of disposing of the fines removed in the solid-liquid separation. In this regard, since the fines are substantially hydrocarbon free on leaving the combustion zone, they may be disposed of in manners conventionally used for handling hydrocarbon free solid wastes.

Modifications of the above described embodiments of the invention process that are obvious to those of skill in the shale processing art or related arts are intended to be within the scope of the following claims.

I claim:

1. In a retort process comprising: introducing fresh hydrocarbon-containing solids having a maximum particle size less than about one cm into the upper portion of a retorting zone; introducing a particulate heat transfer material at an elevated temperature into the upper portion of the retorting zone; introducing a nonoxidizing stripping gas into the lower portion of the retorting zone at a linear velocity that fluidizes at least a portion of the fresh hydrocarbon-containing solids and heat transfer material dropping through the retorting zone and causes mixing therebetween whereby sufficient heat is transferred from the heat transfer material to the fresh hydrocarbon-containing solids to heat the hydrocarbon-containing solids to a temperature at which retorting occurs; withdrawing a mixture of retorted solids and heat transfer material from the retorting zone and introducing it into a combustion zone wherein the char on the retorted solids is combusted to heat the heat transfer material to said elevated temperature; withdrawing an overhead stream from the upper portion of the retorting zone that comprises stripping gas, the vapors of retorting, and entrained fines having a maximum particle size less than about 250 microns; removing a portion of said fines from the overhead stream, said portion being comprised predominantly of particles having a particle size greater than about five microns; thereafter condensing the overhead stream to produce a liquid condensate containing substantially all of the entrained fines remaining in the stream, and removing fines from the condensate to produce a liquid oil product and wet solids, the improvement comprising recycling at least a portion of the wet solids into the combustion zone whereby the condensate component of the wet solids is combusted and the fines component of the wet solids is dried in contact with the mixture of the heat transfer material and the retorted solids.

2. The process of claim 1 wherein the hydrocarbon-containing solids is oil shale.

3. The process of claim 2 wherein the heat transfer material is combusted oil shale.

4. The process of claim 3 wherein the weight ratio of combusted oil shale to fresh oil shale is about 1.5:1 to about 8:1 and said elevated temperature is about 450° C. to about 750° C.

5. The process of claim 3 wherein said linear velocity is in the range of about 0.2 to about 1 m/sec.

6. The process of claim 3 wherein the amount of fines in the overhead stream is about 0.5 to five times the amount of vapors in the overhead stream, by weight.

7. The process of claim 3 wherein the liquid oil product contains less than about 10% by weight fines and the wet solids contains less than 40% by weight condensate.

8. The process of claim 4 wherein said linear velocity is in the range of about 0.2 to about 1 m/sec, the amount of fines in the overhead stream is 0.5 to five times the amount of vapors in the overhead stream by weight, the liquid oil product contains less than about one % by weight fines and the wet solids contains less than 10% by weight condensate.

9. In a retort process comprising: introducing fresh hydrocarbon-containing solids having a maximum particle size less than about one cm into the upper portion of a retorting zone; introducing a particulate heat transfer material at an elevated temperature into the upper portion of the retorting zone; introducing a nonoxidizing stripping gas into the lower portion of the retorting zone at a linear velocity that fluidizes at least a portion of the fresh hydrocarbon-containing solids and heat transfer material dropping through the retorting zone and causes mixing therebetween whereby sufficient heat is transferred from the heat transfer material to the fresh hydrocarbon-containing solids to heat the hydrocarbon-containing solids to a temperature at which retorting occurs; withdrawing a mixture of retorted solids and heat transfer material from the retorting zone and introducing it into a combustion zone wherein the char on the retorted solids is combusted to heat the heat transfer material to said elevated temperature; withdrawing an overhead stream from the upper portion of the retorting zone that comprises stripping gas, the vapors of retorting, and entrained fines having a maximum particle size less than about 250 microns; removing a portion of said fines from the overhead stream, said portion being comprised predominantly of particles having a particle size greater than about five microns; subjecting the portion of the fines removed from the overhead to additional retorting in a second retorting zone and combining the vapors from the second retorting zone with said overhead stream, thereafter condensing the overhead stream to produce a liquid condensate containing substantially all of the entrained fines remaining in the stream, and removing substantially all of the fines from the condensate to produce a liquid oil product and wet solids, the improvement comprising recycling the wet solids into the second retorting zone whereby the condensate component of the wet solids is vaporized and removed and the fines component of the wet solids is dried.

* * * * *